US010774840B2

(12) United States Patent
Young

(10) Patent No.: US 10,774,840 B2
(45) Date of Patent: Sep. 15, 2020

(54) FAN BLADES, FANS, AND A METHOD OF COOLING A ROOM

(71) Applicant: COOL-AIR LLC, Mesa, AZ (US)

(72) Inventor: Lance B. Young, San Tan Valley, AZ (US)

(73) Assignee: COOL-AIR LLC., Mesa, AZ (US)

( * ) Notice: Subject to any disclaimer, the term of this patent is extended or adjusted under 35 U.S.C. 154(b) by 54 days.

(21) Appl. No.: 15/976,358

(22) Filed: May 10, 2018

(65) Prior Publication Data

US 2018/0328377 A1 Nov. 15, 2018

Related U.S. Application Data

(60) Provisional application No. 62/504,499, filed on May 10, 2017.

(51) Int. Cl.

| | |
|---|---|
| ***F04D 29/38*** | (2006.01) |
| ***F04D 29/58*** | (2006.01) |
| ***F04D 25/08*** | (2006.01) |

(52) U.S. Cl.

CPC ..... *F04D 29/388* (2013.01); *F04D 25/088* (2013.01); *F04D 29/584* (2013.01); *F05D 2250/291* (2013.01)

(58) Field of Classification Search

CPC ..... F04D 29/34; F04D 29/388; F04D 29/329; F04D 29/384; F04D 25/088

See application file for complete search history.

(56) References Cited

U.S. PATENT DOCUMENTS

| | | | | |
|---|---|---|---|---|
| 4,422,824 | A | 12/1983 | Eisenhardt, Jr. | |
| 4,782,213 | A | 11/1988 | Teal | |
| 4,840,650 | A | 6/1989 | Matherne | |
| 4,892,460 | A * | 1/1990 | Volk | F04D 25/088 416/62 |
| 4,944,898 | A | 7/1990 | Glaser | |
| 5,795,131 | A | 8/1998 | Crowhurst | |
| 6,726,451 | B2 | 4/2004 | Frampton | |
| 7,674,305 | B2 | 3/2010 | Lillquist | |
| 9,360,020 | B2 * | 6/2016 | Janecek | F04D 25/082 |
| 2007/0155304 | A1 * | 7/2007 | Hyun | F04D 25/088 454/338 |
| 2012/0230822 | A1 | 9/2012 | Pekrul | |
| 2015/0345824 | A1 | 12/2015 | Hentges et al. | |

* cited by examiner

*Primary Examiner* — Kayla Mccaffrey
*Assistant Examiner* — John S Hunter, Jr.
(74) *Attorney, Agent, or Firm* — Snell & Wilmer L.L.P.

(57) ABSTRACT

A fan blade capable of cooling an enclosed space is disclosed, comprising: a leading edge; a trailing edge; a top side; a bottom side; and a plurality of passageways wherein each of the passageways narrows within the fan blade. The plurality of passageways may narrow at any point within the interior of the fan blade and may be shaped in any way to ensure that a narrowing occurs. The plurality of passageways may also be in thermal communication with the rest of the fan blade. The fan blades may be used as part of a fan having a hub and a plurality of fan blades. Also disclosed, is a method of cooling a room comprising rotating a fan, the fan comprising: a plurality of fan blades, each fan blade having a plurality of passageways, wherein each of the passageways narrows within the fan blade.

16 Claims, 6 Drawing Sheets
(1 of 6 Drawing Sheet(s) Filed in Color)

FAN BLADES, FANS, AND A METHOD OF COOLING A ROOM

CROSS-REFERENCE TO RELATED APPLICATIONS

This application claims priority to U.S. Provisional Application No. 62/504,499, filed May 10, 2017, entitled "FAN BLADES, FANS, AND A METHOD OF COOLING A ROOM," which is herein incorporated by reference in its entirety for all purposes.

TECHNICAL FIELD

The disclosure generally relates to fan blades, and more particularly, to fan blades in a ceiling fan for cooling a room.

BACKGROUND

Fans are typically placed in rooms to help circulate air around the space. This movement can help create a breeze in the room, causing it to feel like the room is at a lower temperature without actually causing any change to the temperature of the room. Instead, it is the movement of the air across the sweat present on the skin that increases the rate of evaporation, causing the skin to feel colder, rather than actually causing a decrease in temperature.

In order to cool the temperature in a room, typically central air conditioning units are used. Central air conditioning units consume much higher levels of power than a fan, causing higher energy costs for a typical household. Billions of dollars are spent every year on the electricity costs of central air conditioning. Central air conditioning typically cools multiple rooms, which sometimes is more cooling than needed, for example, when a room is unoccupied.

Accordingly, improved systems and methods for facilitating decreases of temperature in enclosed spaces at lower energy costs are desirable.

SUMMARY

In accordance with various example embodiments, a fan blade capable of cooling an enclosed space is disclosed, comprising: a leading edge; a trailing edge; a top side; a bottom side; and a plurality of passageways wherein each of the passageways narrows within the fan blade. The plurality of passageways may narrow at any point within the interior of the fan blade and may be shaped in any way to ensure that a narrowing occurs. The plurality of passageways may also be in thermal communication with the rest of the fan blade.

The fan blades may also be used in a fan, in accordance with various example embodiments, comprising: a hub and a plurality of fan blades, each fan blade having a leading edge, a trailing edge, a top side, a bottom side, an attachment mechanism, and a plurality of passageways wherein each of the passageways narrows within the fan blade and wherein the attachment mechanism couples to the hub. The fan may further comprise a motor that causes the plurality of fan blades to rotate about the hub.

Also disclosed in accordance with various example embodiments, is a method for cooling a room comprising: rotating a fan, the fan comprising: a motor, a hub, and a plurality of fan blades, each fan blade having a leading edge, a trailing edge, a top side, a bottom side, an attachment mechanism, and a plurality of passageways, wherein each of the plurality of passageways narrows within the fan blade and wherein the attachment mechanism couples to the hub.

BRIEF DESCRIPTION OF THE DRAWINGS

This patent or application file contains at least one drawing executed in color.

Copies of this patent or patent application publication with color drawing(s) will be provided by the Office upon request and payment of the necessary fee.

Figure 1:
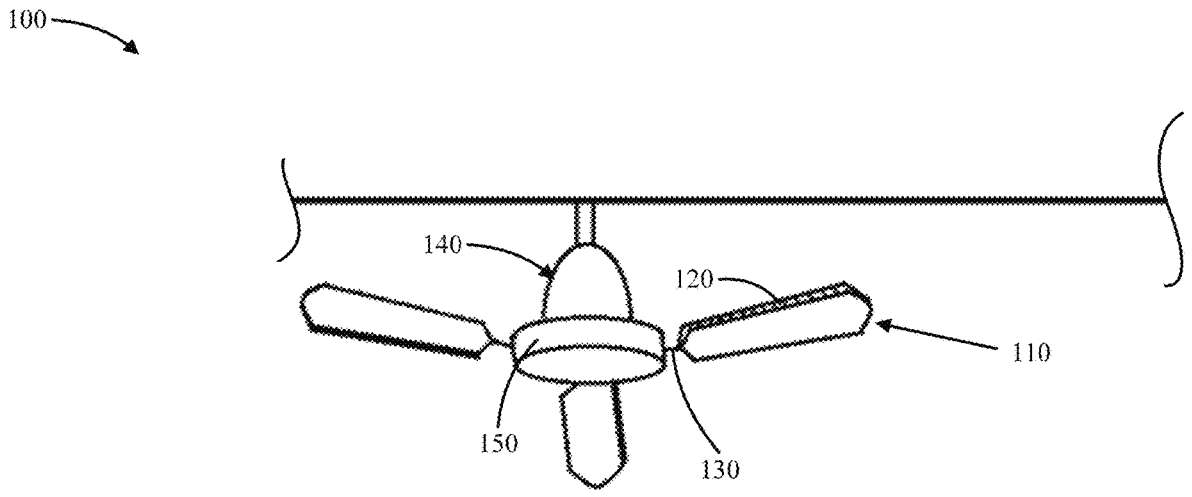
Figure 2:
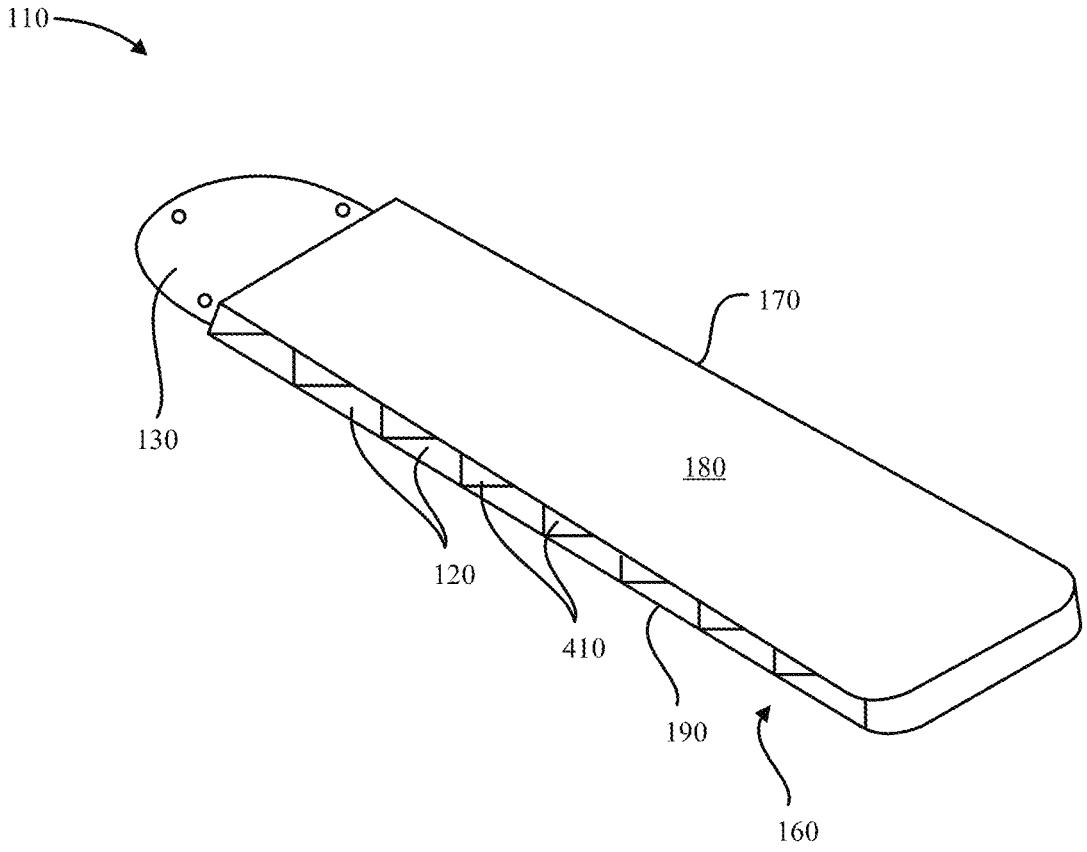
Figure 3:
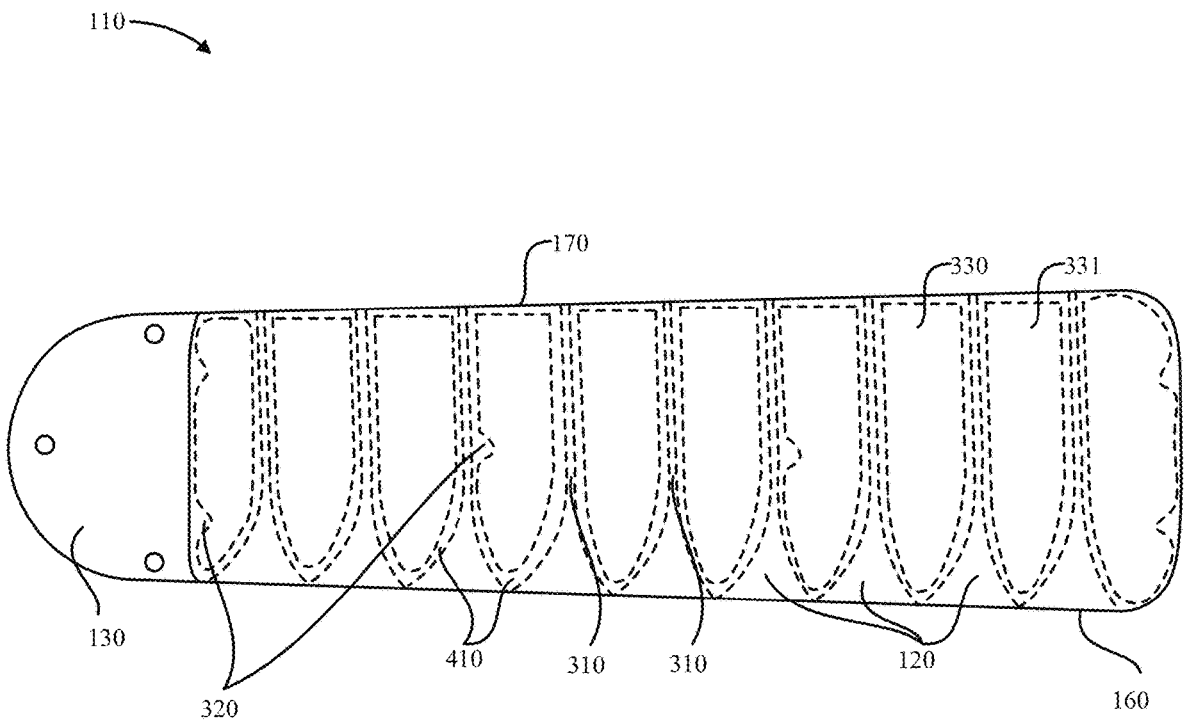
Figure 4:
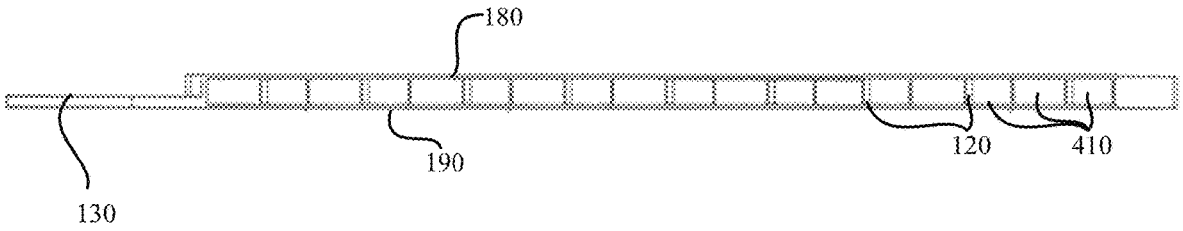
Figure 5:
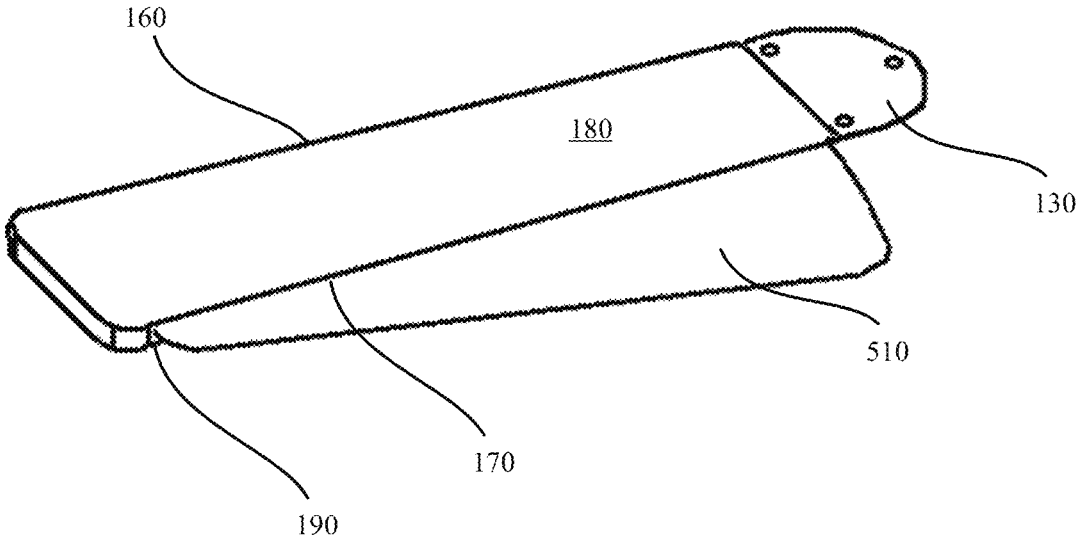
Figure 6:
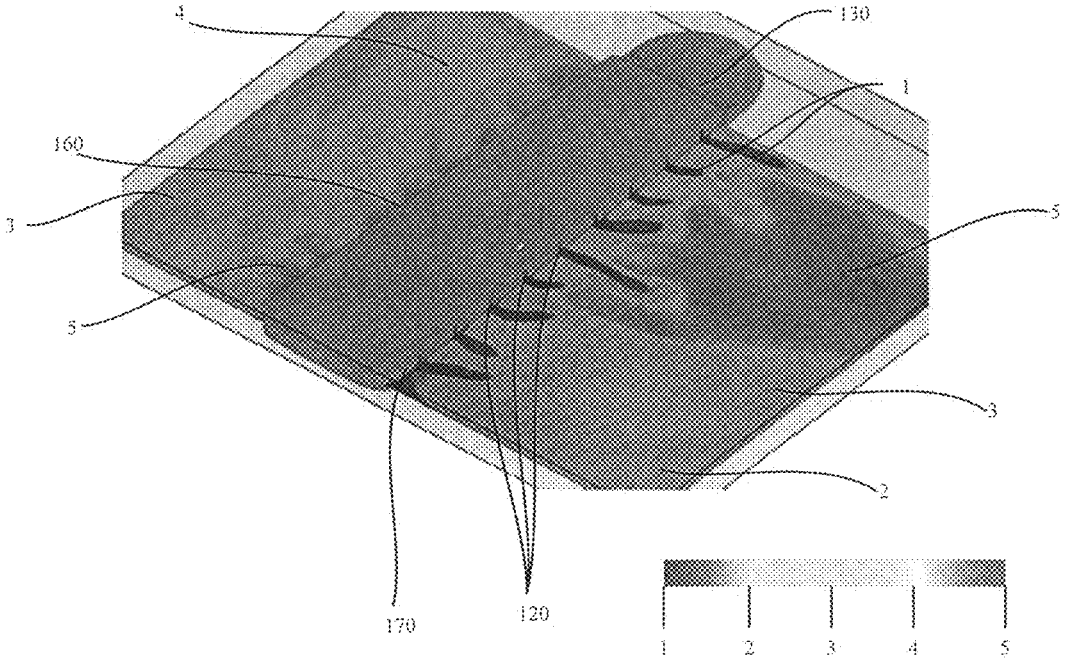

A more complete understanding of principles of the present disclosure may be derived by referring to the detailed description and claims when considered in connection with the Figures, wherein like reference numbers refer to similar elements throughout the Figures, and where:

FIG. 1 illustrates an example of a fan having a plurality of fan blades each with multiple passageways and an attachment mechanism, a motor, and a hub, in accordance with various embodiments;

FIG. 2 illustrates an example of a fan blade having a leading edge, a trailing edge, an attachment mechanism, and a plurality of passageways, in accordance with various embodiments;

FIG. 3 illustrates an internal view of an example fan blade showing a narrowing of the passageways from the leading edge to the trailing edge, in accordance with various embodiments;

FIG. 4 illustrates a side view of an example fan blade having a plurality of passageways, a top side, a bottom side, and an attachment mechanism, in accordance with various embodiments;

FIG. 5 illustrates a back view of an example fan blade having a top side, a bottom side, a leading edge, a trailing edge, an attachment mechanism, and an angled portion, in accordance with various embodiments; and FIG. 6 illustrates a thermal view of an example fan blade as air passes through a plurality of passageways from a leading edge to a trailing edge showing the cooled air as it exits the passageways near the trailing edge.

It should be appreciated by one of ordinary skill in the art that, while principles of the present disclosure are described with reference to the figures described above, such principles may also include a variety of embodiments consistent with the description herein. It should also be understood that, where consistent with the description, there may be additional components not shown in the system diagrams, and that such components may be arranged or ordered in different ways.

DETAILED DESCRIPTION

The detailed description shows embodiments by way of illustration, including the best mode. While these embodiments are described in sufficient detail to enable those skilled in the art to practice the principles of the present disclosure, it should be understood that other embodiments may be realized and that logical and mechanical changes may be made without departing from the spirit and scope of principles of the present disclosure. Thus, the detailed description herein is presented for purposes of illustration only and not of limitation. For example, the steps recited in any of the method descriptions may be executed in any order and are not limited to the order presented.

Moreover, for the sake of brevity, certain sub-components of individual components and other aspects of the system may not be described in detail herein. It should be noted that many alternative or additional functional relationships or physical couplings may be present in a practical system. Such functional blocks may be realized by any number of components configured to perform specified functions.

The disclosure includes a fan blade that has a plurality of passageways that allow air to travel through the blade. The passageways narrow, forcing the volume of air moving through the passageways to compress. The air that passes through the fan blade comes out at a lower temperature than it went in, causing the room to cool. By using a fan blade to cool the temperature in a room rather than to just create air movement in a space, overall energy costs associated with cooling a local space are decreased. In some example embodiments, the fan assembly can be used in conjunction with a central air conditioning unit so that the central air conditioning unit does not need to run as often, leading to a decrease in energy costs.

In various embodiments, an example of a fan comprises a motor, a hub, and multiple fan blades. Each fan blade has a top side, a bottom side, a leading edge, a trailing edge, and a plurality of passageways. The fan blade may also have an attachment mechanism that couples the fan blade to the hub. The motor may spin the hub, causing the fan blades to rotate through the air in the room.

With reference now to FIG. 1, in various example embodiments, a fan 100 comprises a hub 150, a motor 140, and a plurality of fan blades 110. The fan blades 110 comprise a plurality of passageways 120. The fan blades 110 extend outward from the hub 150 and are coupled to the hub 150 by an attachment mechanism 130. The hub 150 is coupled to the motor 140 in such a way that the motor 140 is capable of moving the hub 150. When the motor 140 moves the hub 150 the fan blades 110 are also moved. This movement causes air to flow over the fan blade 110 (like a typical fan blade) and also through the fan blade, as described further herein. The fan 100 causes the blades to move relative to a fixed point of reference, for example, the room, the point of attachment of the fan 100 to the ceiling, or the stator of the motor 140, including any fixed point of reference desired. The fan 100 causes the fan blades 110 to move, radially, in a plane about the hub 150. The hub 150 may be static. The hub 150 may oscillate between left and right positions. The hub 150 may oscillate between up and down positions. The hub 150 may move in any pattern desired.

In various embodiments, each fan blade 110 may have an attachment mechanism 130 that permanently couples the fan blade 110 to the hub 150. In various embodiments, the attachment mechanism 130 may removably couple the fan blade 110 to the hub 150. In various embodiments, the attachment mechanism 130 may be a support with a first end and a second end wherein the first end couples to the fan blade 110 and the second end couples to the hub 150. In various embodiments, the attachment mechanism 130 may be an end piece of the fan blade 110 that fits into an opening in the hub 150. In various embodiments, the attachment mechanism 130 may be a screw, a bolt, a clip, a clamp, or an adhesive that couples the fan blade 110 to the hub 150. It will be appreciated by those in the art that the attachment mechanism 130 may be any piece that is known in the art for coupling a fan blade 110 to a hub 150. Moreover, in various example embodiments, there is no attachment mechanism 130, and the fan blades are coupled directly to the hub 150 or motor 140.

In various embodiments, the fan blades 110 may be attached to the fan 100 with a desired pitch. In various embodiments, the fan blades 110 may be attached to the fan 100 level to the plane of the rotation. In various embodiments, the fan blades 110 may be attached to the fan 100 at an incline between −45° and 45° relative to the plane of the rotation. In various embodiments, the fan blades 110 may be attached to the fan 100 at an incline between −30° and 30° relative to the plane of the rotation. In various embodiments, the fan blades 110 may be attached to the fan 100 at an incline between −15° and 15° relative to the plane of the rotation. In various embodiments, the fan blades 110 may be attached to the fan 100 at an incline between −10° and 10° relative to the plane of the rotation. In various embodiments, the fan blades 110 may be attached to the fan 100 at an incline between −5° and 5° relative to the plane of the rotation. It should be appreciated that the fan blades 110 may be attached to the fan 100 at any desired pitch that allows for air to flow through the passageways 120.

In various embodiments, the motor 140 may be contained within the hub 150. In various embodiments, the motor 140 may be a separate piece that is coupled to the hub 150. In various embodiments, the motor 140 may be contained within a motor housing to shield it from view. In various embodiments, the motor 140 may cause the plurality of fan blades 110 to spin in a clockwise rotation. In various embodiments, the motor 140 may cause the plurality of fan blades 110 to spin in a counterclockwise rotation. In various embodiments, the motor 140 may cause the plurality of fan blades 110 to rotate at between 109 revolutions per minute and 509 revolutions per minute. In other embodiments, the motor 140 may cause the plurality of fan blades 110 to rotate at any suitable revolutions per minute for cooling the air.

In various embodiments, a fan 100 may use one fan blade 110. In various embodiments, a fan 100 may use two fan blades 110. In various embodiments a fan 100 may use three fan blades 110. In various embodiments, a fan 100 may use between four and six fan blades 110. It should be appreciated that any number of fan blades 110 may be used in a fan 100 in accordance with various embodiments. In various embodiments, a fan 100 may have all of the blades be of the type of fan blades 110. In various embodiments, a fan 100 may use a combination of prior art fan blades and fan blades 110 as disclosed herein. In various embodiments, a fan 100 may comprise a configuration of fan blades that alternates between typical fan blades and pass-through fan blades 110 of the present disclosure. In various embodiments, a fan 100 may comprise a configuration of fan blades that has two typical fan blades between each pass-through fan blade 110. In various embodiments, a fan 100 may comprise a configuration of fan blades that groups typical fan blades on one portion of the fan 100 and pass-through fan blades 110 together. It is contemplated that a fan 100 may comprise any configuration of fan blades that incorporates typical fan blades and the pass-through fan blades 110 as described herein.

In various embodiments, a fan 100 may be a ceiling fan. In various embodiments a fan 100 may be a standing fan. In various embodiments a fan 100 may be a tabletop fan. In various embodiments a fan 100 may be a warehouse fan. It should be appreciated that the fan blades 110 described herein may be incorporated into any type of fan 100 known to those in the art.

With reference now to FIG. 2, in accordance with various example embodiments, a fan blade 110 is shown having a leading edge 160, a trailing edge 170, a top side 180, a bottom side 190, and a plurality of passageways 120. Fan blade 110 may also have an attachment mechanism 130. The plurality of passageways 120 are formed by walls 410 that extend between the top side 180 and the bottom side 190 of the fan blade 110. More precisely, the walls 410 may extend from a bottom face of the top side 180 to a top face of the bottom side 190. In an example embodiment each passageway of the plurality of passageways passes between the top side and the bottom side from the leading edge to the trailing edge.

In various embodiments, the walls 410 forming the passageways 120 may extend from the leading edge 160 to the trailing edge 170. In various embodiments, the walls 410 forming the passageways 120 may begin at any point between the leading edge 160 and the trailing edge 170 in the interior of the fan blade 110. In various embodiments, the walls 410 forming the passageways 120 may end at any point between the beginning point and the trailing edge 170 in the interior of the fan blade 110. In various embodiments, the walls 410 may extend perpendicular from the top side 180 and the bottom side 190. In various embodiments, the walls 410 may extend at a desired angle from the top side 180 and the bottom side 190.

In various embodiments, the walls 410 forming the passageways 120 may be in thermal communication with the top side 180 and the bottom side 190 of the fan blade 110. In various embodiments, the walls 410 forming the passageways 120 may be made of a heat sink material. In various embodiments, the heat sink material may be made of an aluminum alloy. In various embodiments, the heat sink material may be made of copper. In various embodiments, the heat sink material may be made of a copper-tungsten pseudo-alloy. In various embodiments, the heat sink material may be made of AlSiC (silicon carbide in aluminum matrix). In various embodiments, the walls 410 forming the passageways 120 may not be in thermal communication with the top side 180 and the bottom side 190 of the fan blade 110. It is contemplated that the walls 410 forming the passageways 120 may be made from any material capable of forming a barrier between two spaces.

Turning now to FIG. 3, a top view of a fan blade 110, in accordance with various example embodiments, is depicted having an attachment mechanism 130, a leading edge 160, a trailing edge 170, and a plurality of passageways 120 that narrow at a point 310 between the leading edge 160 and the trailing edge 170. The plurality of passageways 120 are formed with walls 410. The walls 410 forming the plurality of passageways 120 are configured to narrow the passageways 120 at a point 310 between the leading edge 160 and the trailing edge 170.

In various embodiments, the walls 410 may start at a point near the leading edge 160 and taper away from one another toward the trailing edge 170. In various embodiments, the walls 410 may start at a point near the leading edge 160 and form a straight line away from one another toward the trailing edge 170. It is conceived that the walls 410 could form any shape desired so long as there is a narrowing point 310 between the leading edge 160 and the trailing edge 170. In various embodiments, the passageways 120 may immediately expand after the narrowing point 310. In various embodiments, the passageways 120 may remain narrow after the narrowing point 310. In various embodiments, the passageways 120 may be configured to maximize the amount of time the air stays compressed within the passageways 120. In various embodiments, the passageways 120 may remain narrow for a distance after the narrowing point 310 before expanding. In various embodiments, the passageways 120 may remain narrow for a fraction of the distance between the leading edge 160 and the trailing edge 170. In various embodiments, the passageways 120 may remain narrow for ⅞ of the distance between the leading edge 160 and the trailing edge 170. In various embodiments, the passageways 120 may remain narrow for ⅝ of the distance between the leading edge 160 and the trailing edge 170. In various embodiments, the passageways 120 may remain narrow for ½ of the distance between the leading edge 160 and the trailing edge 170. In various embodiments, the passageways 120 may remain narrow for ⅜ of the distance between the leading edge 160 and the trailing edge 170. In various embodiments, the passageways 120 may remain narrow for ¼ of the distance between the leading edge 160 and the trailing edge 170.

In various embodiments, the walls 410 forming the passageways 120 may be airfoils. In various embodiments, the walls 410 forming the passageways 120 may be symmetrical airfoils. In various embodiments, the walls 410 forming the passageways 120 may be semi-symmetrical airfoils. In various embodiments, the walls 410 forming the passageways 120 may be flat bottom airfoils. In various embodiments, the walls 410 forming the passageways 120 may be airfoils in the shape of a wing. In various embodiments, the walls 410 forming the passageways 120 may be airfoils in the shape of a blade. For example, the walls 410 forming the passageways 120 may be in the shape of a propeller blade, a rotor blade, or a turbine blade. In various embodiments, the walls 410 forming the passageways 120 may be airfoils in the shape of a sail. In an example embodiment, a first airfoil 330 is next to a second airfoil 331. In between the two is the passageway 120 which narrows between the leading edge 160 and the trailing edge 170 due to the shape of the passageway 120 created when the first airfoil 330 is placed next to the second airfoil 331. It is contemplated that the walls 410 forming the passageways 120 may be in any shape that creates a constriction in a passageway when the walls 410 are placed near one another.

In various embodiments, the walls 410 may further comprise notch points 320. In various embodiments, the notch points 320 may be located at any point along the walls 410 forming the passageways 120. In various embodiments, the notch points 320 may serve to reduce the weight of the fan blade 110.

FIG. 4 depicts a side view of a fan blade 110, in accordance with various example embodiments. The fan blade 110 has a top side 180 and a bottom side 190 and a plurality of passageways 120 formed by walls 410. The walls 410 extend from the top side 180 to the bottom side 190.

FIG. 5 depicts a back view of a fan blade 110, in accordance with various example embodiments. The fan blade 110 has a top side 180, a bottom side 190, a leading edge 160, a trailing edge 170, and an attachment mechanism 130. In various embodiments, the fan blade 110 may further comprise an angled portion 510 extending from the top side 180 configured to push the air leaving the trailing edge 170 downward toward the bottom side 190. In various embodiments, the angled portion 510 may be triangular in shape. In various embodiments, the angled portion 510 may be rectangular in shape. It should be appreciated that the angled portion 510 may be in any shape desired. In various embodiments, the angled portion 510 may be straight. In various embodiments, the angled portion 510 may be curvilinear. For example, in one example embodiment, the angled portion may comprise a scoop shape of any suitable radius of curvature. It should be appreciated that the angled portion 510 may be in any shape or configuration and slope at any angle that allows air pushing through the pass-through fan blade 110 to be directed downward toward the bottom side 190.

FIG. 6 depicts a thermal representation of an example cooling effect of the fan blade. In the representation, the number 1 (blue color) represents the coldest temperature followed by 2 (light blue), and then 3 (green). The numbers 4 (yellow) and 5 (red) depict the warmest areas in the air. In various embodiments, the temperature of air at the leading edge 160 is warmer (greater) than the temperature of air at the trailing edge 170 near the outlets of the passageways 120. In various embodiments, the temperature of air at the leading edge 160 is between 1 degree Fahrenheit and 20 degrees Fahrenheit warmer than the air at the trailing edge 170 near the outlets of the passageways 120. In various embodiments, the temperature of air at the leading edge 160 is between 1 degree Fahrenheit and 10 degrees Fahrenheit warmer than the air at the trailing edge 170 near the outlets of the passageways 120. In various embodiments, the temperature of air at the leading edge 160 is between 1 degree Fahrenheit and 7 degrees Fahrenheit warmer than the air at the trailing edge 170 near the outlets of the passageways 120. In various embodiments, the temperature of air at the leading edge 160 is between 2 degrees Fahrenheit and 5 degrees Fahrenheit warmer than the air at the trailing edge 170 near the outlets of the passageways 120. Thus, the red/yellow air depicted at the leading edge 160 and the blue air trailing from the trailing edge 170 illustrate that the fan moving through the air and the air compressing in the fan blade cools the air exiting the passageways.

A fan blade 110 may be utilized for cooling enclosed spaces. Use of pass-through fan blade 110 reduces the temperature of the space in which it is used. As air travels through the pass-through fan blade 110, it is compressed by the narrowing passageways 120. After it exists the passageway at the trailing edge 170, the air is able to expand again. Furthermore, when the walls forming the passageways 120 are made of certain types of materials, for example heat sink materials, the air passing through the passageways 120 may cool the materials, which in turn will cool the next volume of air to move through the cooled passageways (or cool other portions of the fan blade including the top and/or bottom of the fan blade), adding to the cooling effect of the pass-through fan blade 110. This leads to decreased use of air conditioners, and overall energy savings for a household.

While the steps outlined herein represent embodiments of principles of the present disclosure, practitioners will appreciate that there are a variety of physical structures and interrelated components that may be applied to create similar results. The steps are presented for the sake of explanation only and are not intended to limit the scope of the present disclosure in any way. Benefits, other advantages, and solutions to problems have been described herein with regard to specific embodiments. However, the benefits, advantages, solutions to problems, and any element(s) that may cause any benefit, advantage, or solution to occur or become more pronounced are not to be construed as critical, required, or essential features or elements of any or all of the claims.

Exemplary systems and methods are disclosed. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. After reading the description, it will be apparent to one skilled in the relevant art(s) how to implement principles of the disclosure in alternative embodiments.

It should be understood that the detailed description and specific examples, indicating embodiments, are given for purposes of illustration only and not as limitations. Many changes and modifications may be made without departing from the spirit thereof, and principles of the present disclosure include all such modifications. Corresponding structures, materials, acts, and equivalents of all elements are intended to include any structure, material, or acts for performing the functions in combination with other elements. Reference to an element in the singular is not intended to mean "one and only one" unless explicitly so stated, but rather "one or more." Moreover, when a phrase similar to "at least one of A, B, or C" or "at least one of A, B, and C" is used in the claims or the specification, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A fan blade comprising:

a leading edge;

a trailing edge;

a top side;

a bottom side;

a first wall extending from the top side to the bottom side and the leading edge to the trailing edge, the first wall disposed proximate a root of the fan blade;

a second wall extending from the top side to the bottom side and the leading edge to the trailing edge, the second wall spaced apart spanwise to the first wall, the first wall and the second wall defining a first passageway, the first passageway being more narrow at the trailing edge than the leading edge;

a third wall extending from the top side to the bottom side and the leading edge to the trailing edge, the third wall disposed adjacent to the second wall; and a fourth wall extending from the top side to the bottom side and the leading edge to the trailing edge, the fourth wall spaced apart spanwise from the third wall, the third wall and the fourth wall defining a second passageway, the second passageway being more narrow at the trailing edge than the leading edge.

2. The fan blade of claim 1, wherein the first wall, the second wall, the third wall, and the fourth wall are in thermal communication with the top side and the bottom side of the fan blade.

3. The fan blade of claim 1, wherein the second wall and the third wall define an airfoil shape.

4. The fan blade of claim 1, wherein one or more of the top side, the bottom side, the first wall, the second wall, the third wall, and the fourth wall are formed of a heat sink material.

5. The fan blade of claim 1, wherein a temperature at the leading edge is greater than a temperature at the trailing edge during operation of the fan blade.

6. The fan blade of claim 1, the fan blade further comprising a scoop on the top side of the trailing edge.

7. The fan blade of claim 1, further comprising a flange, wherein the flange couples the fan blade to a hub of a fan assembly, and wherein the first wall is disposed proximate the flange.

8. A fan comprising:

a hub; and a plurality of fan blades, each fan blade comprises:

a leading edge, a trailing edge, a top side, a bottom side, a first wall extending from the top side to the bottom side and the leading edge to the trailing edge, the first wall disposed proximate the hub, a second wall extending from the top side to the bottom side and the leading edge to the trailing edge, the second wall spaced apart spanwise to the first wall, the first wall and the second wall defining a first passageway, the first passageway being more narrow at the trailing edge than the leading edge, a third wall extending from the top side to the bottom side and the leading edge to the trailing edge, the third wall disposed adjacent to the second wall; and a fourth wall extending from the top side to the bottom side and the leading edge to the trailing edge, the fourth wall spaced apart spanwise from the third wall, the third wall and the fourth wall defining a second passageway, the second passageway being more narrow at the trailing edge than the leading edge.

9. The fan of claim 8, further comprising a motor, wherein the motor causes the plurality of fan blades to rotate about the hub, wherein air enters the first passageway and the second passageway at the leading edge and exits the first passageway and the second passageway at the trailing edge while the plurality of fan blades rotate.

10. The fan of claim 8, wherein the plurality of fan blades spin at between 109 revolutions per minute and 509 revolutions per minute.

11. The fan of claim 8, wherein the first wall, the second wall, the third wall, and the fourth wall are in thermal communication with the top side and the bottom side of the fan blade.

12. The fan blade of claim 8, wherein the second wall and the third wall define an airfoil shape.

13. The fan blade of claim 8, wherein one or more of the top side, the bottom side, the first wall, the second wall, the third wall, and the fourth wall are formed of a heat sink material.

14. The fan of claim 8, wherein a temperature at the leading edge of each fan blade is greater than a temperature at the trailing edge of each fan blade during operation of the fan.

15. The fan of claim 8, wherein each fan blade further comprises a scoop on the top side of the trailing edge.

16. A method of cooling a room comprising:

rotating a fan, the fan comprising:

a motor;

a hub; and a plurality of fan blades, each fan blade comprising:

a leading edge, a trailing edge, a top side, a bottom side, a first wall extending from the top side to the bottom side and the leading edge to the trailing edge, the first wall disposed proximate the hub, a second wall extending from the top side to the bottom side and the leading edge to the trailing edge, the second wall spaced apart spanwise to the first wall, the first wall and the second wall defining a first passageway, the first passageway being more narrow at the trailing edge than the leading edge, a third wall extending from the top side to the bottom side and the leading edge to the trailing edge, the third wall disposed adjacent to the second wall, and a fourth wall extending from the top side to the bottom side and the leading edge to the trailing edge, the fourth wall spaced apart spanwise from the third wall, the third wall and the fourth wall defining a second passageway, the second passageway being more narrow at the trailing edge than the leading edge.

* * * * *